United States Patent [19]

Essex et al.

[11] Patent Number: 4,911,453

[45] Date of Patent: Mar. 27, 1990

[54] TARGET SYSTEM

[76] Inventors: Timothy L. Essex, 2032 Pressler Rd., Akron, Ohio 44312; Dwight L. Puckett, 1400 S. Azalia Blvd., Barberton, Ohio 44203

[21] Appl. No.: 364,894

[22] Filed: Jun. 12, 1989

[51] Int. Cl.[4] ..... F41J 9/02

[52] U.S. Cl. ..... 273/359; 273/370; 273/406

[58] Field of Search ..... 273/406, 369, 370, 348 R, 273/359, 385; 434/16

[56] References Cited

U.S. PATENT DOCUMENTS

| | | | |
|---|---|---|---|
| 3,392,980 | 7/1968 | Ortega | 273/406 |
| 3,733,073 | 5/1973 | Gutler | 273/406 |
| 3,914,819 | 10/1975 | Taylor et al. | 273/406 |

*Primary Examiner*—Benjamin Layno
*Attorney, Agent, or Firm*—Oldham & Oldham Co.

[57] ABSTRACT

A target system is provided which is designed to be initially set in a non-visible position and to subsequently be triggered to pop-up to a position visible to a marksman. Once in an upright, visible position, the target will travel downwardly and subsequently fall out of view after a predetermined amount of time. During operation, the target simulates natural movements of a person or animal and thus provides a more realistic target for the marksman. The target system comprises a target supporting structure which is movable in guide channels in an operating mechanism which is positionable in an initial set position and may be selectively triggered to assume an upright or shooting position. The target system is safe and effective in its operation and allows the user great flexibility and control of the system.

16 Claims, 5 Drawing Sheets

FIG-1
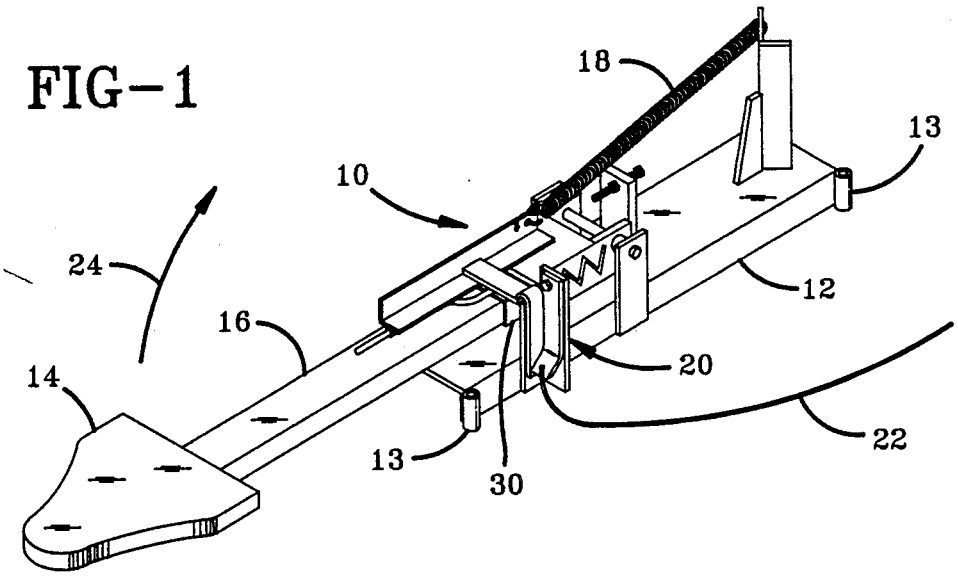
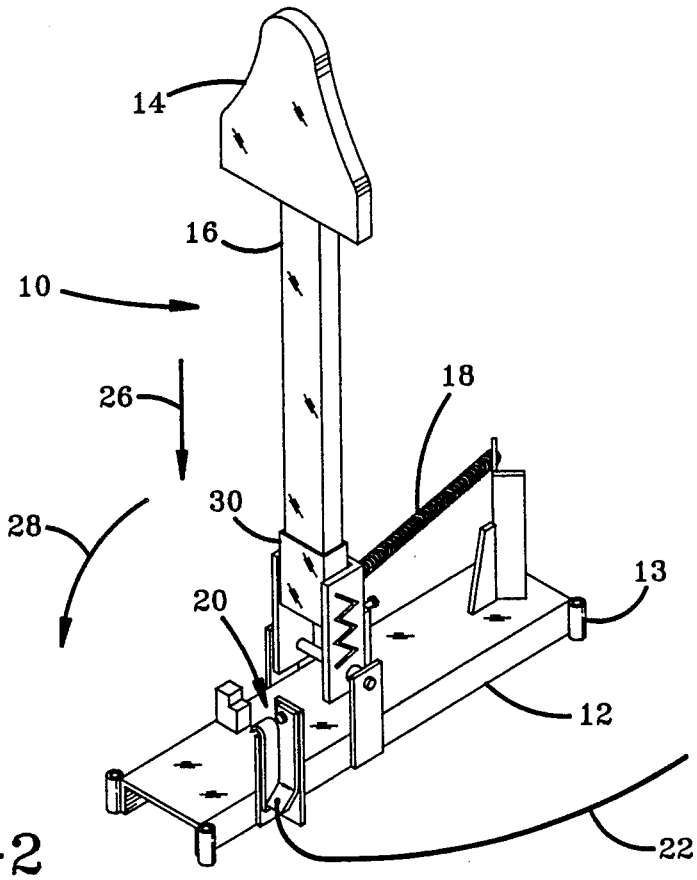
FIG-2

TARGET SYSTEM

BACKGROUND OF THE INVENTION

This invention relates to a target system which may be used for a variety of purposes such as marksman practice as well as training exercises in the use of weapons or the like. More particularly, the invention relates to a target system which is designed to be initially set so as to not be visible to the user and to be subsequently triggered so as to come into view of the user for a selective period of time after which the target will again disappear from view.

There are known systems where a target is positioned so as to be initially visible to the marksman and after being hit by a projectile will be dislodged and moved to another position so as to not be visible or so as to present a different appearance to the marksman. An example of such a target is shown in U.S. Pat. No. 1,310,643 which includes a plurality of targets which are slidably positioned in relation to a supporting structure such that upon hitting of the bulls eye by the marksman, the target will change positions relevant to the support.

Other target systems may comprise a target which is mounted on rollers or the like so as to be movable horizontally across a supporting structure. Thus, the moving targets are presented for a person to shoot at as may be found in shooting galleries or like places. One example of such a system is shown in U. S. Pat. No. 1,471,521, wherein a movable target simulates the actions or movements of animals or the like which they represent. The target, which may constitute a sheet of metal, is pivotally mounted upon a carriage such that it is capable of swinging vertically into and out of an operative position. A detent device holds the target plate in its normal position and releases the plate when hit by the marksman. Other similar systems may simply allow the target to be withdrawn from view upon being hit a projectile from the marksman.

There are also other target systems- which are designed to be flipped into an upward position and set for use. The pop-up target may also be designed to be withdrawn from view of the marksman upon being hit thereby indicating that the target has been hit. In another type of target which may be controlled electronically or pneumatically, the target is made to move in and out of sight of the marksman by simply moving a rod or the like to which the target is attached by means of chain drive mechanisms or the like.

From the foregoing, it should be recognized that there is a need for a target system which presents a more realistic life-like situation to the marksman. This is the case particularly in the use of target systems as training aids for police officers or other law enforcement personnel who must react to dangerous situations with precision and control. The target system to be useful in such situations, should force the marksman to react in a similar fashion to that of a live situation as well as present a more life-like target response which simulates the movements of a person or animal. In most situations, such training exercises or shooting competitions are conducted at gun ranges or similar locations which are located in relatively remote areas to ensure safety. Thus, a mechanical target system is desirable in that the availability of electricity or pneumatic power at such remote locations is rare. The target system must also be durable to withstand environmental conditions as well as the chance of being struck by a bullet or other projectile and should maintain its operating characteristics uniformly over an extended period of time.

SUMMARY OF THE INVENTION

It is therefore a main object of the present invention to provide a target system which simulates real-life situations as well as the natural movements of a person or animal as desired. The present invention provides a reactionary target system which forces reactions by the marksman as would be the case in live situations and is therefore ideal for use as a training aid or as a measure of the skill of the marksman in competitions or the like.

It is another object of the invention to provide a mechanical target system which is highly durable, safe and effective and which maintains its operating characteristics over time.

It is yet another object of the invention to provide a target system which is initially set so as to not be visible to a marksman and which subsequently can be triggered so as to become visible to the marksman for a selective period of time after which the target will disappear from sight.

Another object of the invention is to provide a target system which when visible to a marksman may be provided with movements which simulate various natural movements of a person or animal as selectively desired.

Yet another object of the invention is to provide a target system having operating characteristics which may be varied by the user and which can accommodate different environmental conditions.

These and other objects of the invention are accomplished by a target system comprising a target holding structure movably coupled to an operating mechanism which is selectively placed between an initial set position, wherein the target in the target holding structure will not be visible to a marksman, and a shooting position which will bring the target within the target holding structure into view of the marksman. The operating mechanism includes guide means in which the target holding structure is movably retained such that the target holding structure may selectively be moved within the guide means due to the force of gravity when the operating mechanism is in its shooting position. The target holding structure further includes a retaining rod member slidably coupled to the operating mechanism such that the target holding structure will be retained in a selected position with respect to the operating mechanism and may then be released to assume a second position with respect to the operating mechanism according to the movement of the target holding structure within the guide means.

The operating mechanism is retained in its initial set position by means of a triggering device enabling the operating mechanism to be released and acted upon by a force applying member so as to assume its shooting position. An adjustment mechanism allows the shooting position of the operating mechanism to be varied according to the particular environmental or physical conditions in which the target system is utilized to vary its operation selectively. A base support member carries the adjustment mechanism as well as supporting structure for the force supplying means and the triggering structure. The operating mechanism is pivotally supported on the base member and several safety features are provided in conjunction with these elements. The base member is designed to be firmly secured in the ground or other anchoring media or may itself be secured to another base structure as desired.

BRIEF DESCRIPTION OF THE DRAWINGS

Other objects and advantages of the invention will become apparent from a reading of the following detailed description taken in conjunction with the accompanying drawings wherein;

FIG. 1 is a perspective view of the target system shown in its initial set position before use;

FIG. 2 is a perspective view of the target system as shown in FIG. 1 when triggered showing the initial relative movements of the elements thereof;

DETAILED DESCRIPTION OF THE INVENTION

Figure 3:
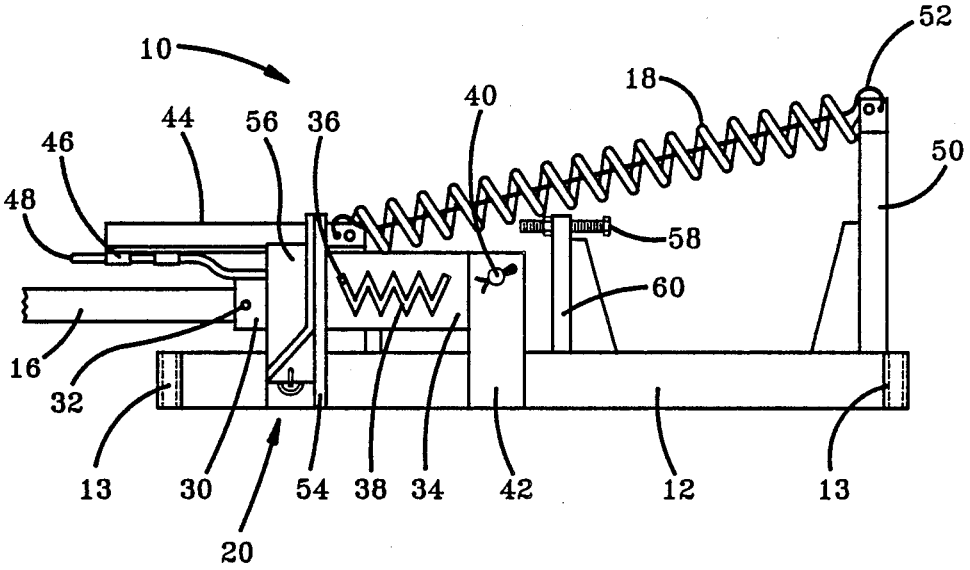
FIG. 3 is a side elevational view of the target system when in the initial set position as in FIG. 1 showing more particularly the elements thereof.

Referring now to the drawings wherein like reference numerals indicate like elements, FIGS. 1 and 2 show the target system 10 in its initial set position as well as immediately after being triggered to an upright shooting position respectively. As seen in FIG. 1, the target system 10 comprises a base portion 12 which is anchored into the ground or similar anchoring media by spikes or the like driven through rings 13 such that it is secure and stable in this position. In the set position as shown in FIG. 1, a target 14 which is mounted on a post 16 lie substantially parallel to the base 12 and subsequently out of view of a marksman or user of the system. The post 16 is disposed in a target holding structure 30 forming part of the target system to be described hereinafter. The target 14 is placed in the set position as shown in FIG. 1 by pulling the target 14 against the force of spring member 18 and locking it into position by means of a triggering mechanism 20 which may have a cable 22 or other similar means attached thereto to initiate triggering of the target.

Upon pulling of cable 22, the target 14 is released from its locked position and the pulling force of the spring 18 acts to rapidly pull the target into an upright position or shooting position as shown in FIG. 2. At this point, the target 14 will be plainly visible to the marksman. Thus, the cable 22 may be used to trigger the set target apparatus as shown in FIG. 1 such that the target 14 moves upwardly as shown by arrow 24. Upon reaching the upright position as shown in FIG. 2, the target 14 will then travel downwardly due to gravity as shown by arrow 26 wherein the target 14 will be visibly moving as seen by the marksman. As the target 14 travels downwardly, it will be released from an operating mechanism of the target system 10 such that the target 14, post 16, and target holding structure 30 will then fall backward and down as shown by arrow 28 so as to fall out of sight of the marksman.

Thus, in operation, the target 14 will initially be out of sight of the marksman and upon triggering of the target system 10 will pop the target 14 into view of the marksman after which the target 14 will again disappear from view after a selected amount of time. In this way, the target system 10 simulates real-life situations as well as the natural movements of a person or animal to force the marksman to react quickly and accurately if he is to hit the target while it is in view. It should be seen that from the initial upright position as shown in FIG. 2, the target 14 is made to move downwardly and also forward and backward to some extent as well as side-to-side if desired. The simulation of a live situation thus makes the target system 10 ideal for use as a training aid as well as giving shooting competitions varying aspects which would increase the enjoyment of the participants.

The operation of the target system as described with reference to FIGS. 1 and 2 will be more fully described with reference to the remaining Figures.

Turning now to FIG. 3, the target system 10 is shown in its initial set position similar to that of FIG. 1. As mentioned hereinbefore, a base 12 supports the components of the target system 10 and allows the target system to be anchored into the ground or other location. In the set position, the spring 18 is placed in tension and the target post 16 is substantially horizontal to the base 12. As mentioned previously, the post 16 is positioned in a target supporting structure 30 and may be secured thereto by means of a dry wall screw or other suitable securing means 32. The target supporting structure 30 is movably secured in an operating mechanism 34 by means of an axle 36 secured thereto and positioned in a guide means 38 formed in the operating mechanism 34. The guide means 38 comprises a zig-zag channel formed on opposed parallel sides of the operating mechanism 34 which is substantially U-shaped having its open end facing downwardly. The operating mechanism 34 is pivotally secured at point 40 to opposed parallel supporting structures 42 which are secured to the base 12. The supporting structures 42 comprise metal plates which may be welded to the base 12 in an upstanding position as shown. The operating mechanism 34 is pivotally secured to the plates 42 by means of an axle at 40 to enable relative rotation about this point.

The operating mechanism 34 also has secured thereto an outwardly extending support bar 44 having at least one retaining ring 46 disposed thereon which accommodates retaining rod 48 extending from the target supporting structure 30 so as to be slidably retained by the retaining rings 46. The retaining rod 48 has a length such that as the axle 36 travels down the guide means 38 formed in the operating mechanism 34, the target supporting structure 30 will be maintained in an upright position similar to the operating mechanism 34 until the retaining rod 48 is released from the rings 46. Upon being released from the retaining rings 46, the target supporting structure 30 is then free to pivot about the axle 36 and to assume an alternate position relative to the operating mechanism 34.

There is also provided a spring support member 50 mounted on the base 12 having an operative height so as to provide the proper amount of pulling force upwardly on the operating mechanism 34 to which the spring 18 is attached. The proper amount of force depends upon the physical characteristics of the target to be used with the system, and it should be recognized that the support member 50 could have a greater height to provide a stronger pulling force on the operating mechanism 34, or alternatively be shorter to provide less force. A cable 52 may be secured between the spring support member 50 and the support bar 44 of the operating mechanism 34 through the spring 18 to ensure that the spring 18 cannot be released in the event of breakage.

In the set position as shown in FIG. 3, the operating mechanism is held against the tension of the spring 18 by means of the triggering mechanism 20 having a support 54 and a trigger 56 pivotally mounted thereon. The triggering mechanism 20 will be more fully described hereinafter, but is designed so as to be safely operated to release the operating mechanism 34 when desired so as to be drawn up by the tension of spring 18 into a position as shown in FIG. 4.

Figure 4:
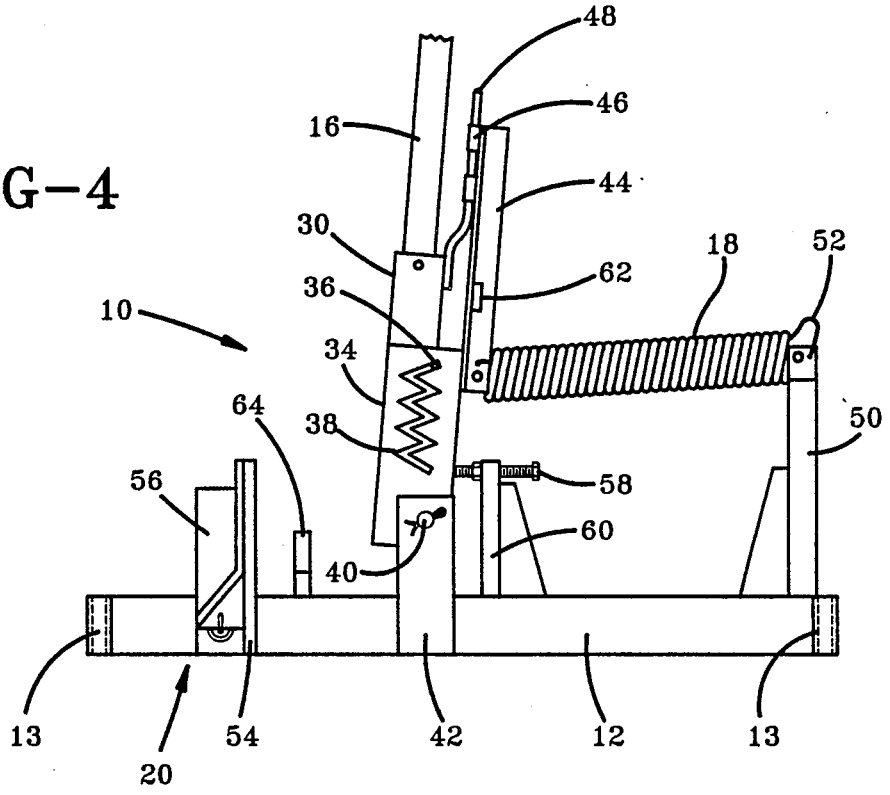
FIG. 4 is a side elevational view of the target system in its upright shooting position as in FIG. 2 immediately after triggering of the device.
Figure 5:
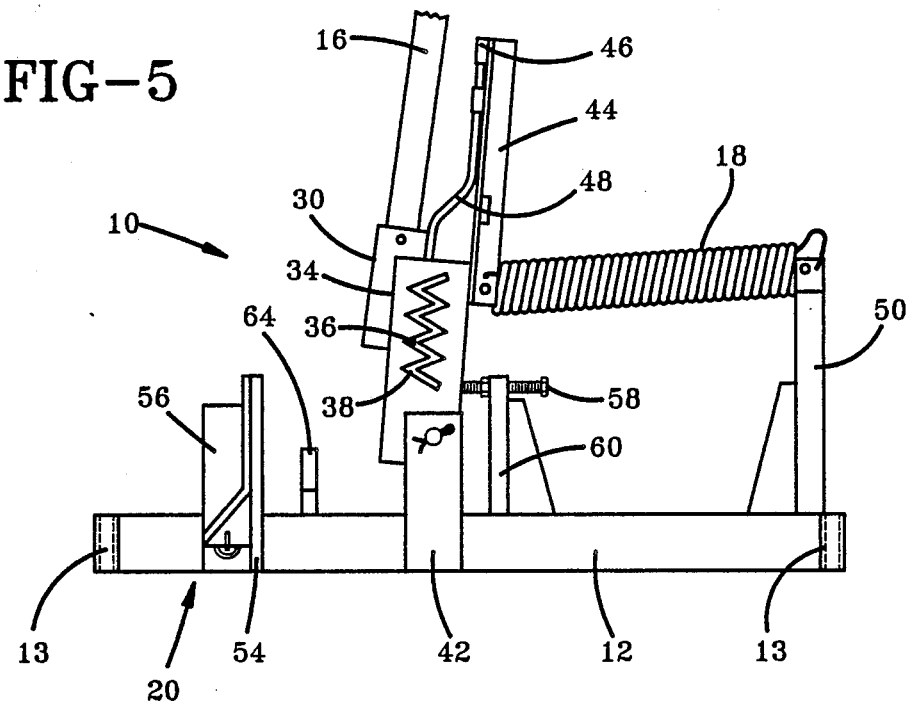
FIGS. 5, 6, 7, and 8 show side elevational views of progressive stages of movement of the target holding structure relative to the operating mechanism to which it is movably coupled showing the operation of the target system.

As seen in FIG. 4, a target mounted on the post 16 is brought into an upright or shooting position wherein it will be visible to the marksman. The spring force of spring 18 is designed to flip the operating mechanism 34 upwardly very quickly about its pivot axis at axle 40. The operating mechanism 34 pivots about the axle 40 until being stopped by an adjustment mechanism 58 which comprises a bolt mounted on support 60 which may be variably positioned to extend a selected distance towards the operating mechanism 34 as seen in FIG. 4. The adjustment mechanism 58 thus enables selective positioning of the operating mechanism 34 when in the upright position to yield the desired operating characteristics for the target system and to allow the target supporting structure to fall after being released. The position of the operating mechanism 34 when upright is important in that proper operation of the target system will depend upon the environmental conditions encountered along with the angle at which the base member 12 is positioned. Thus, for example, the target system 10 may be set to account for any wind which may be acting on the target or the slope of the land on which the target is placed.

Also seen in FIG. 4, is the trigger latch 62 mounted on the support bar 44 of the operating mechanism 34. The trigger latch 62 engages the trigger 56 of triggering mechanism 20 when in the set position as shown in FIG. 3. The relative positions of the operating mechanism 34 and target supporting structure 30 as seen in FIG. 4, are shown immediately after being brought into the upright position by the spring 18 upon being triggered. As will being seen more fully hereinafter, an operating mechanism retaining member or stop 64 is provided to keep the operating mechanism 34 in its proper position relative to the triggering mechanism 20 to prevent accidental triggering of the target system and provide additional safety features.

Turning now to FIGS. 5, 6, 7, and 8 the sequence of operation of the target system 10 after being brought into the upright position as shown in FIG. 4 is shown. After initially being brought into the upright position, the target supporting structure 30 which is slidably disposed in the guide means 38 by means of axle 36 will be acted upon by gravity so as to begin traveling down the guide means 38 while being retained relative to the operating mechanism 34 by means of retaining rod 48 disposed in rings 46. As will be seen from FIG. 5, the axle 36 and therefore target supporting structure 30 is made to walk down the zig-zag guide means 38 due to the weight of the post 16 and target mounted thereon. As the target supporting structure 30 walks down the guide means 38, the target which is mounted on the post 16 is made to move back and forth thereby simulating natural movements of a person or animal as desired. The retaining rod 48 maintains the target supporting structure 30 in an upright position along with the operating mechanism 34 during the downward movement of the target supporting structure 30 relative to the operating mechanism 34 and to facilitate the forward and backward movement of the target supporting structure 30 as described.

Figure 6:
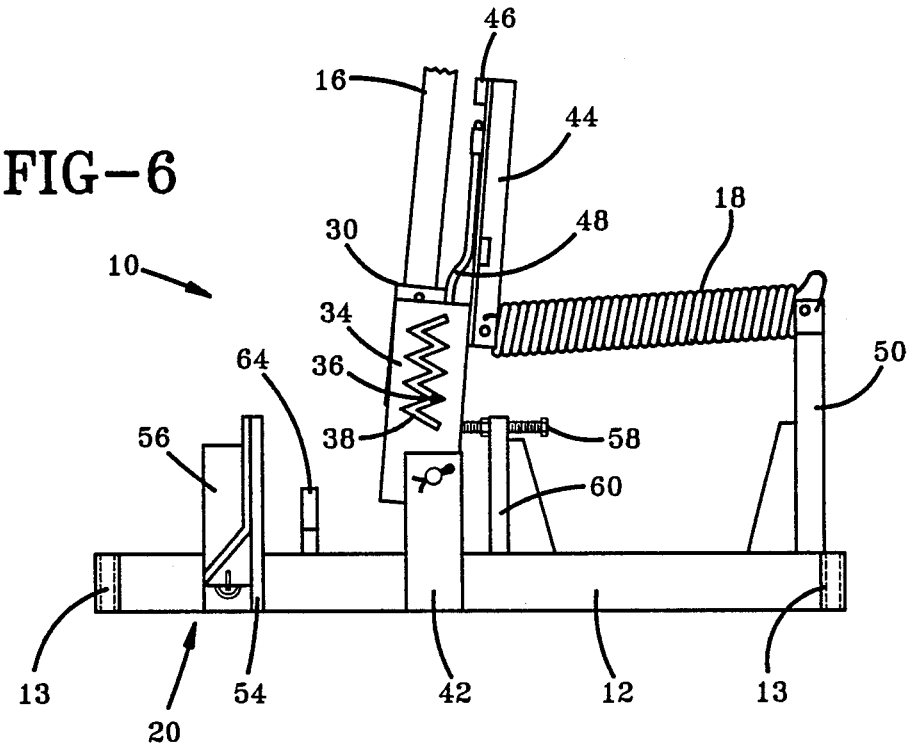
Figure 7:
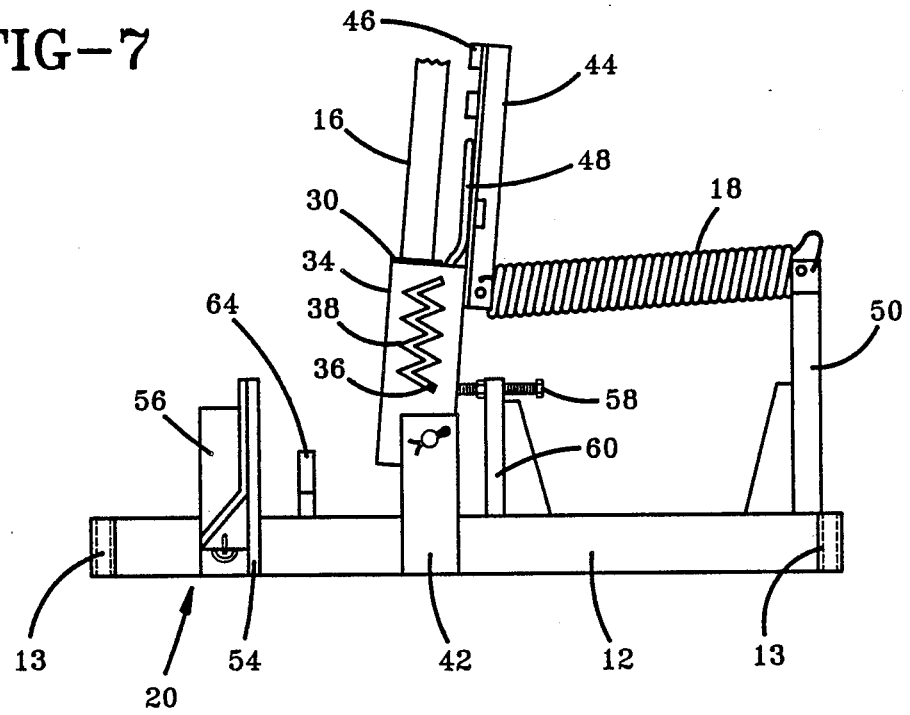
Figure 8:
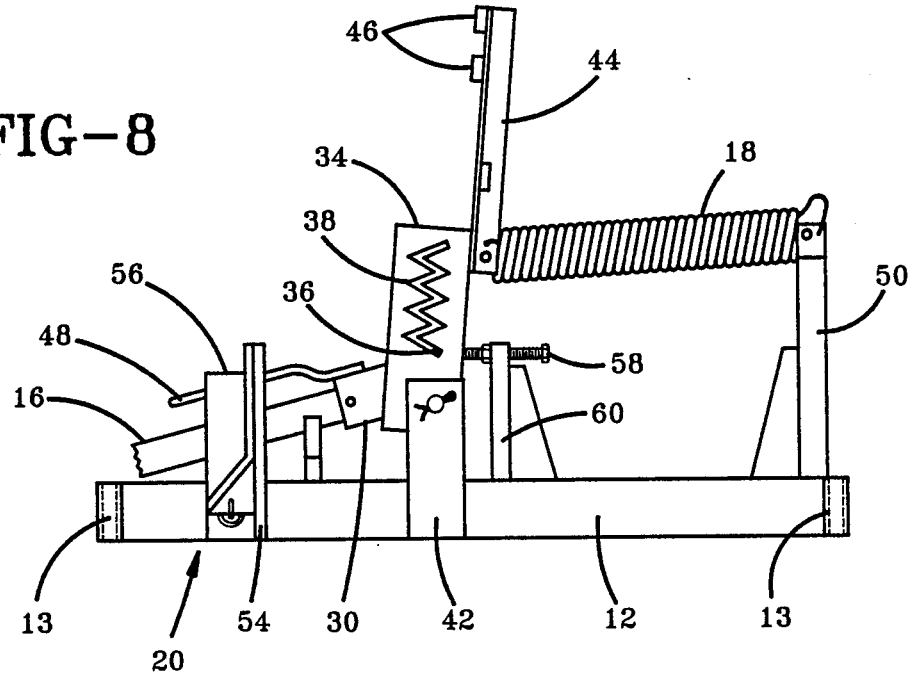

As seen in FIG. 6, the continued downward movement of the target supporting structure 30 relative to the operating mechanism 34 also moves the retaining rod 48 downwardly relative to the retaining rings 46 of the support bar 44. As seen in FIG. 7, the target supporting structure 30 travels downwardly until the axle 36 has moved to the end of the guide means 38 where its downward movement will be stopped. The length of the guide means 38 is designed such that at the end of the downward movement of target supporting structure 30, the retaining bar 48 mounted on the target supporting structure will be released from the retaining rings 46 mounted on the support bar 44 of the operating mechanism 34. As seen in FIG. 8, once the retaining bar 48 has been released from the retaining rings 46, the adjustment mechanism 58 is set so as to kick out the target supporting structure 30 due to the force of gravity thereby letting it fall backward and downwardly about the pivot axis at axle 36. The target mounted on post 16 will thus be made to fall out of sight of the marksman after it has been visible for a selected amount of time thus requiring quick reaction and accurate shooting to score a hit on the target.

From the position as seen in FIG. 4 to the position as shown in FIG. 8, the target may be visible to the marksman for approximately two seconds or any selected period of time as desired by the user. For example, the guide means 38 may be extended to allow for extending travel of the target supporting structure 30 thereby lengthening the time in which the target is visible. Alternatively, the target supporting structure 30 may initially be positioned already half way down the guide means 38 so that the travel thereof is reduced and the time in which the target is visible is also reduced. Other various modifications to vary the amount of time in which the target is visible should be evident and are contemplated by the present invention. It should also be recognized that the adjustment mechanism 58 sets the angle at which the operating mechanism 34 is positioned so as to effectively kick the target holding structure 30 out upon breaking away from the support bar 44.

Figure 9:
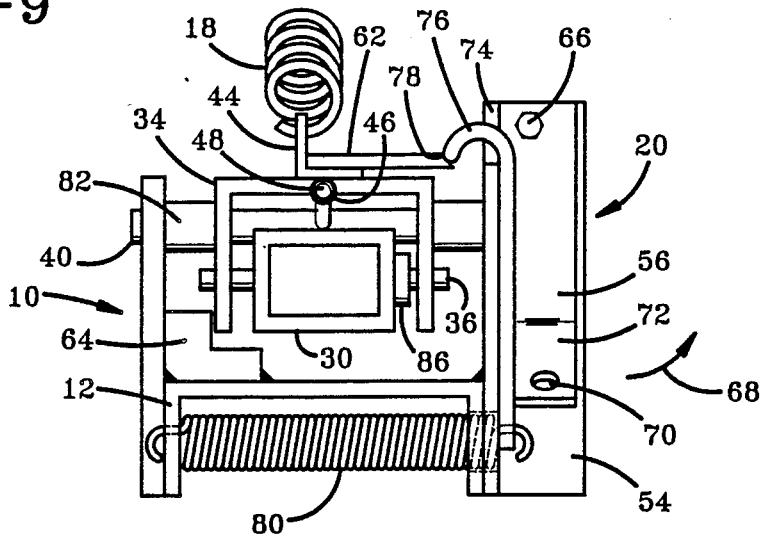
FIG. 9 is an enlarged view of the triggering mechanism of the target system.

Turning now to FIG. 9, the triggering mechanism 20 is seen more clearly. The trigger support 54 is welded on to the base 12 of the target system 10 and pivotally supports trigger 56 at point 66. The trigger support 54 is substantially L-shaped along with the trigger 56 so as to support the trigger 56 on two outer sides thereof. The trigger 56 is pivotally movable in the direction of arrow 68 by means of a cable or other suitable means connected to an aperture 70 formed in an area 72 of the trigger 56 which has been bent away from the trigger support 54. Alternatively a solenoid could be connected to the trigger 56 at this location to selectively pull the trigger 56 outwardly when actuated. The trigger support 54 has a cut out zone 74 from the side wall which is secured to the base 12. The trigger 56 includes a bent over engaging portion 76 directed toward the base 12 through the cut out zone 74. The portion 76 has dimensions so as to contact the trigger latch 62 disposed on the support bar 44 of the operating mechanism 34. The trigger latch 62 includes a tapered outer surface 78 which is held by the engaging portion 76 of the trigger 56 in a secure manner until the trigger 56 is pivoted outwardly when actuation of the target is desired.

As mentioned previously, the spring 18 is placed in tension in the set position as shown in FIG. 9, and is pulling upwardly on the support bar of 44 of operating mechanism 34. The trigger latch 62 is thereby provided with an upwardly directed force against the portion 76 of the trigger 56 to force the trigger 56 into the position as shown in FIG. 9 to firmly and securely hold the trigger 56 in this position and thereby prevent accidental or unexpected triggering of the target system. As the upwardly directed force is quite strong, the tapered surface 78 reduces the amount of force necessary to pivot the trigger 56 outwardly and thereby release the trigger latch 62 for actuation of the target system. There is also provided a trigger return spring 80 disposed between the side walls of the base 12 and coupled to the lower end of the trigger 56 through apertures formed in the base 12 and trigger support 54 to return the trigger 56 to its initial position after actuation. An additional safety feature is provided by a stop L-bracket 64 which is positioned directly adjacent the side wall of the operating mechanism 34 opposite that of the triggering mechanism 20 to retain the operating mechanism 34 in the proper position relative to the trigger 56 and prevent lateral movement thereof and accidental triggering of the target system. The operating mechanism 34 is also properly positioned by spacers 82 and 84 situated on the axle 40. A spacer 86 may also be provided on the target supporting structure 30 to keep its position constant such that the target supporting structure will always break away from the operating mechanism 34 at the same point and make operation of the target system 10 uniform. It should be evident that an alternate triggering mechanism could be employed if desired.

Figure 10:
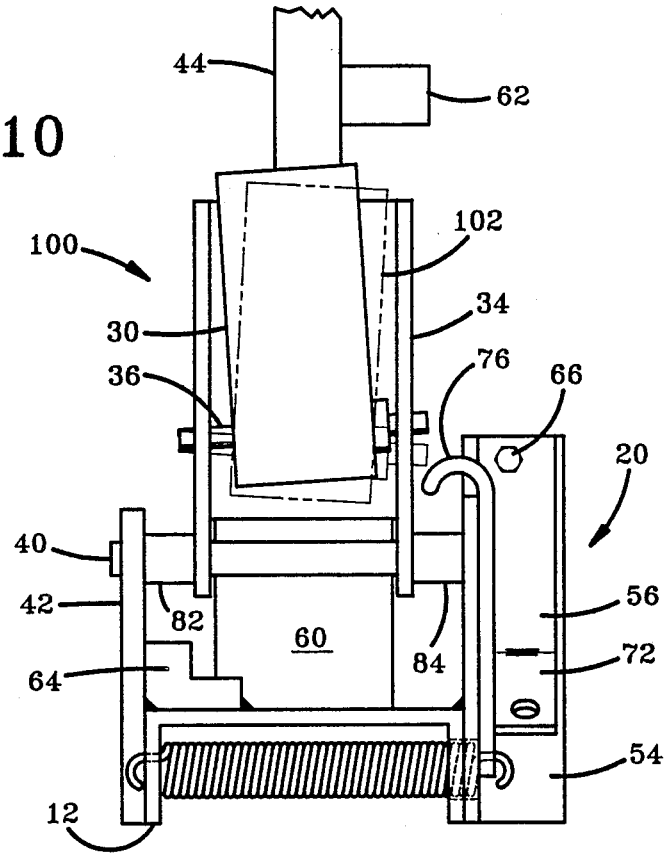
FIG. 10 is a partially cut-away enlarged view of the operating mechanism and target holding structure in an alternate embodiment thereof.

Turning now to FIG. 10, an alternate embodiment of the target system is generally shown at 100. This embodiment is substantially identical to that previously described except that lateral movement of the target supporting structure 30 is enabled to give the target additional movement when the target supporting structure 30 moves downwardly in the guide means of the operating mechanism 34. This lateral movement may be accomplished by eliminating the spacer 86 of the previous embodiment and offsetting or skewing the position of the axle 36 through the target supporting structure 30. The target supporting structure will then have room for movement within the space between the side walls of the operating mechanism 34 and steps down the guide means of the operating mechanism 34 in a somewhat irregular fashion as shown by ghost lines 102. In this manner, the target which is mounted on a post disposed in the target supporting structure 30 will be made to move laterally as well as forward and backward further giving the moving target a more realistic impression during its downward movement while visible to the marksman.

It should be recognized that the present invention provides a reactionary target system which is set initially out of sight of a marksman and may be triggered to pop into view for a selected amount of time as desired. Triggering of the target system may be accomplished in a wide variety of ways mechanically and either electronically or pneumatically as desired. The target system may be conveniently anchored into the ground or may be positioned on an additional supporting structure to be easily portable or to be movable by mounting the target on wheels for example. The target system is adjustable so as to operate effectively in varying environmental conditions or the like. The target system forces the shooter to react quickly for the target is only in view for a short of period of time and the simulated movement of the system will change the available target area at which to shoot requiring high precision on the part of the marksman. The target system is both safe and effective in its operation and allows the user great flexibility and control of the system. For example, the target system could be easily modified to provide a pop-up target only by firmly securing the target supporting structure 30 to the operating mechanism 34. Alternatively, the pivoting motion of the target supporting structure could be prevented to provide a target which pops into view and then moves back and forth or laterally simulating natural movements.

It is to be understood that the invention is not limited to the exact detail of construction, operation, materials or embodiments shown and described, as obviously modifications will be apparent to those skilled in the art. Accordingly, the invention is therefore to be limited only by the scope of the appended claims.

What is claimed is:

1. A target system comprising a base, an operating mechanism pivotally coupled to said base, a target supporting means movably coupled to said operating mechanism, a trigger means supported on said base enabling said operating mechanism to be positioned in an initial set position, a force applying means acting on said operating mechanism such that upon release from said initial set position by said trigger means, said operating mechanism will assume a shooting position, said target supporting means being acted on by gravity when said operating mechanism is in said shooting position so as to move relative to said operating mechanism.

2. A target system as in claim 1, wherein said operating mechanism further includes guide means in which said target supporting means moves relative to said operating mechanism when said operating mechanism is in said shooting position.

3. A target system as in claim 2, wherein said guide means comprises a zig-zag channel formed in said operating mechanism in which said target supporting means is slidably engaged.

4. A target system as in claim 1, wherein said operating mechanism is a U-shaped housing having guide means formed in the opposed sides thereof in which said target supporting means is movably coupled by means of an axle disposed in said guide means to which said target supporting means is pivotally coupled.

5. A target system as in claim 1, wherein said operating mechanism includes a support means extending therefrom having a retaining means positioned thereon, said target supporting means having means slidably coupled with said retaining means to maintain said target supporting means relative to said operating mechanism for at least a portion of said relative movement therebetween.

6. A target system as in claim 5, wherein said operating mechanism includes guide means formed therein in which said target supporting means is movably coupled and said target supporting means moves within said guide means until said means slidably coupled with said retaining means is released from said retaining means thereby enabling said target supporting means to pivot downwardly due to gravity away from said operating mechanism such that a target coupled with said target supporting means will be removed from said shooting position and from sight.

7. A target system as in claim 1 further comprising, an adjustment means to selectively vary the position of said operating mechanism in said shooting position.

8. A target system as in claim 1, wherein said trigger means comprises a trigger support coupled to said base and a trigger pivotally coupled to said trigger support having an engaging portion which will contact said operating mechanism so as to retain said operating mechanism in said initial set position, said trigger and capable of being selectively pivoted so as to release said operating mechanism.

9. A target system as in claim 8, wherein, said trigger is coupled to a second force applying means which is coupled to said base and will act to return said trigger to an initial position after actuation thereof.

10. A target system as in claim 8, wherein, said operating mechanism includes a trigger latch means which said engaging portion will contact to retain said operating mechanism in said initial set position wherein said trigger latch means includes a tapered outer surface which acts to reduce the amount of force necessary to pivot said trigger means and release said trigger latch means.

11. A target system as in claim 1, wherein said force applying means is a spring disposed between a support means coupled with said base and said operating mechanism and further including a safety cable disposed therein to retain said spring in substantially this position in the event of breakage.

12. A target system as in claim 1 further comprising, a stop means positioned adjacent said operating mechanism in said initial set position to prevent any lateral movement of said operating mechanism and thereby prevent accidental triggering of the target system.

13. A target system as in claim 1, wherein said target supporting means is coupled to said operating mechanism by means of an axle disposed in guide means formed in said operating mechanism so as to be slidable within said guide means and pivotable about said axle.

14. A target system as in claim 13, wherein said axle is skewed relative to said target supporting means such that upon sliding of said axle within said guide means of said operating mechanism said target supporting means will also move laterally relative to said operating mechanism.

15. A target system comprising a base having a pivotally supported operating mechanism thereon, said operating mechanism being coupled to a force applying means and being positionable in an initial set position against a bias force of said force applying means, a target supporting means coupled to said operating mechanism and movable relative thereto in a guide means formed in said operating mechanism, said target supporting means also including first retaining means slidably coupled with said operating mechanism so as to maintain said target supporting means as it moves in at least a portion of said guide means, trigger means to release said operating mechanism from said initial set position to be acted on by said force applying means thereby positioning said operating mechanism in a shooting position wherein said target supporting means will move through said guide means due to gravity.

16. A target system as in claim 15, wherein said operating mechanism includes a support means extending therefrom and including second retaining means positioned thereon, said first retaining means being dimensioned so as to be released from said second retaining means thereby enabling said target supporting means to pivot downwardly due to gravity away from said operating mechanisms such that a target coupled with said target supporting means will be removed from said shooting position and sight.

* * * * *